United States Patent [19]

Göbel

[11] 3,958,374

[45] May 25, 1976

[54] ANCHOR ASSEMBLY

[76] Inventor: Klaus Göbel, Am Forst, 55 Trier, Germany

[22] Filed: Aug. 20, 1975

[21] Appl. No.: 606,013

Related U.S. Application Data

[63] Continuation-in-part of Ser. No. 458,830, April 8, 1974, abandoned.

[30] Foreign Application Priority Data

Apr. 21, 1973 Germany ..... 2320445

[52] U.S. Cl. ..... 52/60; 52/96

[51] Int. Cl.[2] ..... E04D 1/36; E04D 13/14

[58] Field of Search ..... 52/58–62, 52/169, 222, 701, 702, 96, 97

[56] References Cited

UNITED STATES PATENTS

| | | | |
|---|---|---|---|
| 1,905,017 | 4/1933 | Vallas | 52/61 |
| 2,226,886 | 12/1940 | Willis | 52/62 |
| 2,974,448 | 3/1961 | Weis | 52/62 |
| 3,132,445 | 5/1964 | Swanson | 52/58 |
| 3,365,847 | 1/1968 | Josek | 52/58 |
| 3,410,038 | 11/1968 | Göbel | 52/62 |
| 3,562,971 | 2/1971 | Göbel | 52/60 |
| 3,731,439 | 5/1973 | Hickman | 52/62 |
| 3,793,795 | 2/1974 | Annand | 52/169 |

FOREIGN PATENTS OR APPLICATIONS

| | | | |
|---|---|---|---|
| 1,205,105 | 9/1970 | United Kingdom | 52/61 |

*Primary Examiner*—J. Karl Bell
*Attorney, Agent, or Firm*—Robert W. Beach; R. M. Van Winkle

[57] ABSTRACT

An anchor assembly for a flexible sheet of a roof covering, or a roof connecting strip, has a hollow section rail running along an upright wall section projecting upward from an edge of the roof, such as a parapet, at a location spaced upwardly from the roof. Such rail has a longitudinal slot bounded by upper and lower generally coplanar flanges and an upwardly projecting pocket-like extension which receives a thickened edge portion of the sheet. The sheet edge portion is thickened and forms a lip which bears against one of the flanges to anchor such edge portion.

2 Claims, 7 Drawing Figures

ANCHOR ASSEMBLY

This application is a continuation-in-part of U.S. application Ser. No. 458,830, filed Apr. 8, 1974, for Anchor Assembly now abandoned.

BACKGROUND OF THE INVENTION

1. Field of the Invention

This invention relates to apparatus for anchoring the edge of a roof covering or of a roof connecting strip in a hollow section rail having a horizontal slot bounded by upper and lower flanges.

2. Prior Art

For holding the edge of a roof covering or of a roof connecting strip, it is known to use roof cover terminal sections or wall connecting sections in which the edge of the sheet to be held is wrapped around a stiffening member and clamped by a clamping rail. In addition, it is also known to form the edge of the roof covering or roof connecting strip as a bead and to insert the beaded edge into a clamping member of a roof cover terminal section or wall connecting section.

However, the known arrangements have the disadvantage that a secure seat is not ensured and assembly is often difficult.

SUMMARY OF THE INVENTION

An object of the invention is therefore to provide apparatus whereby the edge of a sheet constituting a roof covering or roof connecting strip can be installed quickly and without special expert knowledge and, after installation, a secure anchor is ensured.

Accordingly the invention provides an anchor assembly between a hollow section rail and a sheet edge portion of roof covering or a roof connecting strip, wherein the hollow section rail has a horizontal slot bounded by upper and lower generally coplanar flanges. The hollow section rail further has an upwardly projecting hollow extension forming a pocket for reception of the roof sheet edge portion. The roof sheet edge portion has a thickened margin and a lip is provided on the thickened margin which projects oppositely from the roof sheet edge. The lip seats behind one of the rail flanges to anchor the roof sheet in the rail hollow.

Advantageously, the thickened margin of the roof covering or of the roof connecting strip and the lip are formed as layers by folding over several times the portion of the roof covering or the roof connecting strip adjacent to the sheet edge and bonding the folds together. Alternatively, strips of the sheet material may be laminated on the sheet edge margin.

Preferably the upper flange bounding the rail slot has an integral marginal extension which projects from the flange proper into the hollow of the rail. The pocket-forming extension of the rail is advantageously inclined obliquely upward and toward the brickwork or parapet on which the rail is supported.

BRIEF DESCRIPTION OF THE DRAWINGS

The invention will be described further, by way of example, with reference to the accompanying drawings, in which.

DETAILED DESCRIPTION

Figure 1:
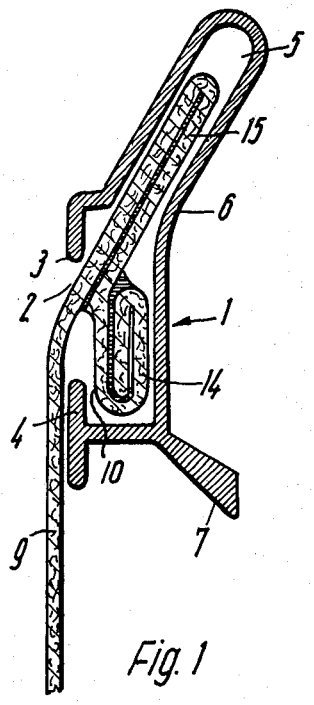
FIG. 1 is a vertical section through an anchor assembly of the present invention.

The preferred embodiments of anchor assembly in accordance with the invention includes a hollow section rail 1 having a horizontal, longitudinal slot 2 which is bounded by upper and lower substantially coplanar flanges 3 and 4. Such rail is adapted to be mounted on an upright wall extending upwardly from and along a roof margin, such as a parapet. The rail is spaced upward from the roof. The rail has an extension forming a pocket 5 which is directed obliquely upward and toward the upright wall on which the rail is mounted. Provided at the transition between the main cavity of the hollow section rail 1 and the pocket extension 5 is a bend 6 which is on the rail side adjacent to the wall on which the rail is supported. Bend 6 changes the direction of the wall of pocket 5 opposite slot 2, so that the length of the pocket is disposed at an angle for guiding the thickened margin portion 14 of the roof sheet 9 adjacent to edge 15 as the margin is inserted into the rail. Margin 14 is thereby disposed in an inclined position relative to the adjacent unthickened portion of sheet 9. Such inclined position tends to maintain the lip 10 in seating or anchoring position and prevents bending or twisting movement of the margin 14 in a manner which would permit lip 10 to be unseated.

Figure 2:
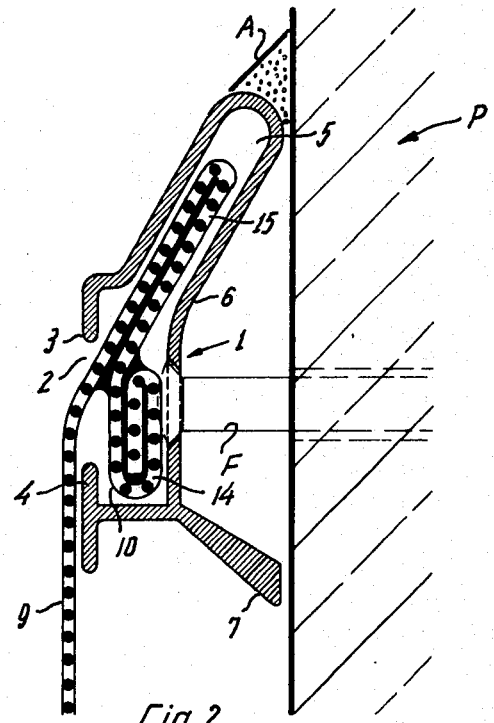
FIG. 2 is a similar view of the assembly mounted on a roof parapet.
Figure 3:
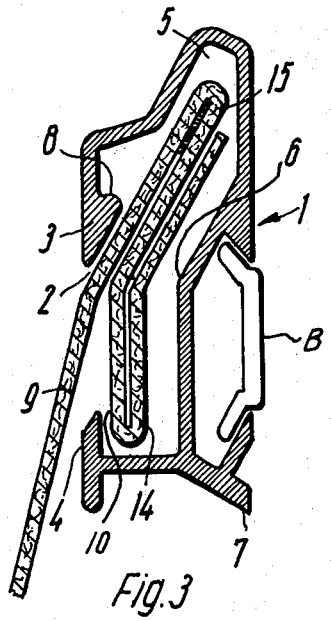
FIG. 3 is a vertical section through a further embodiment of the anchor assembly.
Figure 4:
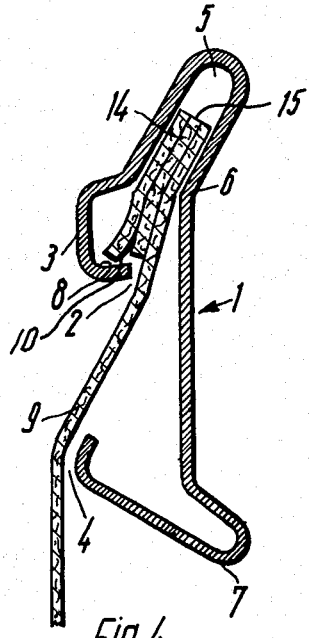
FIG. 4 is a vertical section through another embodiment of the anchor assembly.
Figure 5:
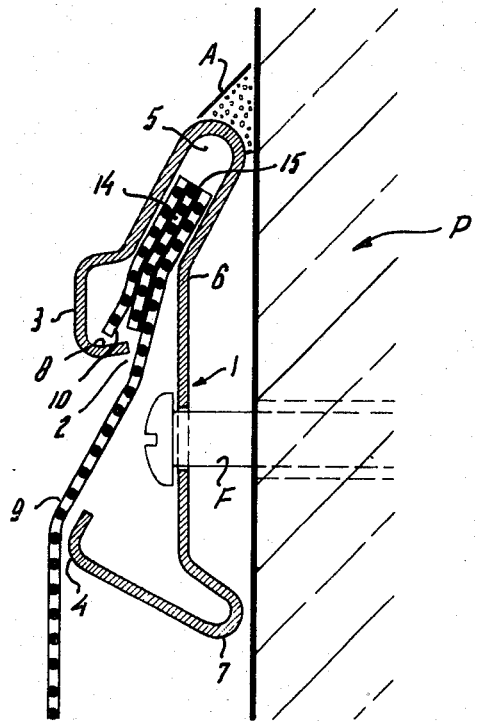
FIG. 5 is a similar view of the assembly mounted on a roof parapet.

In the rails of FIGS. 1 and 4, the bend 6 disposes the pocket 5 in a position projecting upward and toward the parapet P (FIGS. 2 and 5). Furthermore, arranged on the hollow section rail 1 is a bearing member 7 which projects obliquely from the lower rail end toward the parapet. As seen in FIGS. 2, 5 and 7, the rails 1 of FIGS. 1, 4 and 6, respectively, are mounted on the parapet P by fasteners F which may be bolts screwed into anchor tubes embedded in concrete of the parapet or mortar between two rows of bricks forming the parapet. The fasteners extend through the back wall of rail 1 and are protected by roofing sheet 9 to avoid leakage around the fasteners. As shown in FIGS. 2, 5 and 7, inclined pocket 5 and the retaining member 7 tend to bear aginst the parapet. Asphalt A or other appropriate material is used as filler along the top of the rail to prevent moisture from entering between the rail and the parapet. The rail of FIG. 3 can be mounted by a bracket B in a well-known manner. such as shown in FIG. 1 of U.S. Pat. No. 3,562,971.

Figure 6:
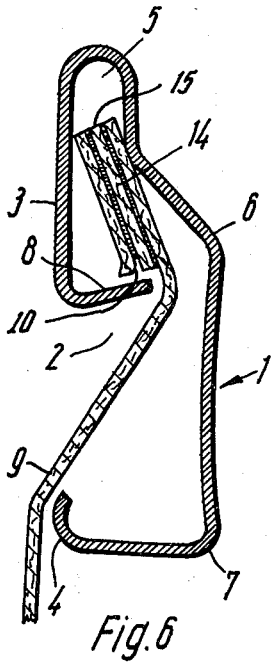
FIG. 6 is a vertical section through yet another embodiment of the anchor assembly, and FIG. 7 a similar view of the assembly mounted on a roof parapet.
Figure 7:
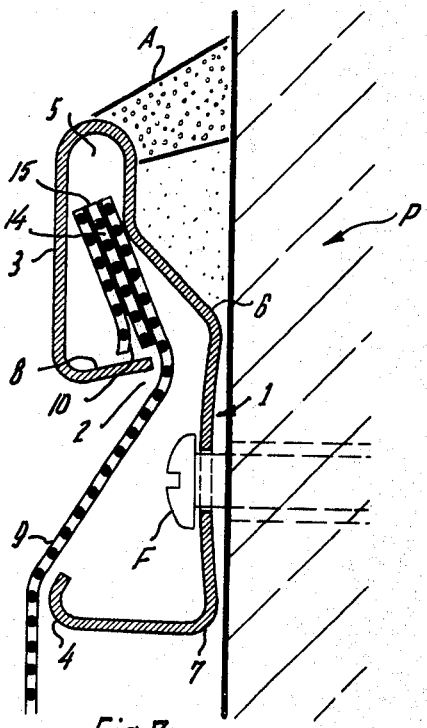

In accordance with the embodiments of FIGS. 3, 4 and 6, the upper flange 3 bounding the slot 2 has an integral marginal extension 8 which projects from the flange proper into the hollow of the rail 1. Such extension bears against the roof sheet 9 to deter entry of wind-driven rain, for example. Extension 8 further serves to restrict the opening between the main rail hollow and the pocket 5 to limit movement of sheet 9 as described further below.

In accordance with the invention, the margin of the roof covering is thickened at 14 and is formed as a lip 10 spaced from and projecting oppositely from the roof sheet edge 15. The margin of the roof sheet 9, which sheet may be a roof covering or a roof connecting strip, is folded several times and the folds are connected together, such as by bonding, as can be seen from the drawings, as shown in FIGS. 1 and 3. Alternatively, strips of the roof sheet material may be laminated together and to the roof sheet margin, as shown in FIGS. 4 and 6. In either case, the thickened margin 14 is formed by layers of the roof sheet material and, therefore, has the same expansion and contraction characteristics as roof sheet 9. In each embodiment, it can be seen that the lip 10 is formed by terminating the bonding adhesive short of the lower edge of the thickened margin 14 between one pair of layers.

During insertion of the margin 14 of the roof sheet, the lip 10 is pressed against the face of roof covering or the roof connecting strip 9 by bearing against the outer side of seating flange 4 of rail 1 (FIGS. 1 and 3) or extension 8 of seating flange 3 (FIGS. 4 and 6). After passing through the slot 2, the lip spreads from the adjacent face of sheet 9 or layer of thickened marginal portion by its own resilience. Such spreading is facilitated by the adjacent seating flange acting as a wedge so that the lip is disposed behind the lower flange 4 (FIGS. 1 and 3) or the upper flange 3 (FIGS. 4 and 6) of the rail and functions like a barb if sheet 9 is pulled downwardly.

Also, the roof sheet edge 15 projects into the pocket extension 5 thereby maintaining the margin 14 in a lip-spreading attitude and providing a barrier to entry of wind-driven water behind the roof sheet 9. The pocket 5 accommodates a major extent of the relatively rigid edge margin 14, which is sufficient to prevent the seated roof sheet 9 from being dislodged by pulling or by normal expansion and contraction during ambient temperature changes. Any downward or outward pull on sheet 9 only wedges the seating flange more firmly behind the lip 10 and the thickened margin 14 embraced by pocket 5 provides such resistance to bending or deformation that the sheet margin cannot be removed from the rail unless sheet 9 is sliced off from its thickened margin to permit access of a prying tool between the lip and its seating flange and to permit sufficient localized movement of margin 14 to pry it out essentially inch-by-inch.

I claim:

1. An anchor assembly for an edge portion of a flexible roof sheet including a hollow section rail adapted to be mounted on an upright wall projecting upward from a roof edge, such rail having a horizontal slot opening into the hollow of the rail and bounded by upper and lower generally coplanar flanges, the improvment comprising the roof sheet marginal portion being thickened and including lip means spaced from and projecting oppositely from the roof sheet edge for seating behind one of the rail flanges and the rail including a hollow extension forming pocket means for reception of the roof sheet edge for securing the thickened roof sheet marginal portion in the hollow section rail.

2. The assembly defined in claim 1, in which the thickened roof sheet marginal portion includes a plurality of layers of the roof sheet material, said layers being bonded together.

* * * * *